United States Patent [19]

Cox

[11] 4,045,032

[45] Aug. 30, 1977

[54] GAMES PRACTICE NET AND PROTECTVE SCREEN

[75] Inventor: John William Andrew Cox, Arbroath, Scotland

[73] Assignee: Macleisure Limited, Scotland

[21] Appl. No.: 572,851

[22] Filed: Apr. 29, 1975

[30] Foreign Application Priority Data

May 1, 1974 United Kingdom ..... 19083/74

[51] Int. Cl.[2] ..... A63B 69/36; E04B 1/347

[52] U.S. Cl. ..... 273/181 F; 273/182 A; 135/1 R; 273/127 B

[58] Field of Search ..... 273/181, 182, 176 F, 273/176 FA, 176 FB, 127 B; 135/1 R, 5 B

[56] References Cited

U.S. PATENT DOCUMENTS

| | | | |
|---|---|---|---|
| 255,106 | 3/1882 | Farrow | 135/1 R |
| 357,329 | 2/1887 | McKoon | 135/1 R |
| 1,116,074 | 11/1914 | Jones | 135/1 R |
| 1,545,772 | 7/1925 | Jacobs | 273/181 A |
| 3,197,208 | 7/1965 | Makar | 273/181 F |

*Primary Examiner*—George J. Marlo

*Attorney, Agent, or Firm*—Larson, Taylor and Hinds

[57] ABSTRACT

A practice net and protective screen incorporates a sheet of flexible material which has a quadrilateral center portion and two triangular wing portions, the bases of which are common with respective opposite parallel sides of the quadrilateral center portion. A ring is located on each of the six corners of the sheet. Cords join the rings at the ends of the bases of each triangular wing portions. Cords may join all adjacent pairs of rings around the periphery of the sheet. The rings may be formed by loops of cord.

4 Claims, 3 Drawing Figures

GAMES PRACTICE NET AND PROTECTVE SCREEN

The subject of this invention is a games practice net and protective screen for use in practising such games as cricket and golf and as a wind break for sun bathing for example.

It is an object of the present invention to provide a games practice net and protective screen which is cheap to produce and is easily erected.

A games practice net and protective screen according to the invention incorporates a sheet of flexible material the shape of which is such that it has a quadrilateral centre portion and two triangular wing portions so orientated that the bases of the triangular wing portions are common with respective opposite parallel sides of the quadrilateral centre portion, the sheet thus having six sides and six corners, a ring located at each corner of the sheet, and cords joining the rings at the ends of the bases of each triangular wing portion.

Cords may be provided joining all adjacent pairs of rings around the periphery of the sheet.

The rings may be formed by loops of cord. In this construction the cord forming the rings at the ends of the bases of each triangular wing portion may be continuations of the cords joining the rings.

The flexible material of which the practice net and screen is made may be netting where the primary use of the invention is game practice or may be woven or non-woven material with wind breaking properties where the invention is to be used additionally or only as a wind break.

In erecting the net it is necessary to use two poles which may be any type of pole conveniently available and cut to the appropriate length but which preferably are pointed at one end each to penetrate an appropriate ring in the net. There may additionally be provided along with the poles dished plates, the other (unpointed) end of each pole being engaged with the depression in a respective plate in well known manner to prevent the pole from sinking into the ground.

Figure 1:
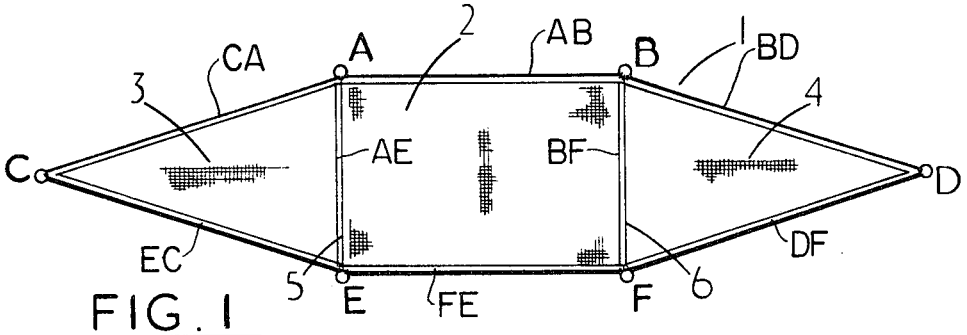
Figure 3:
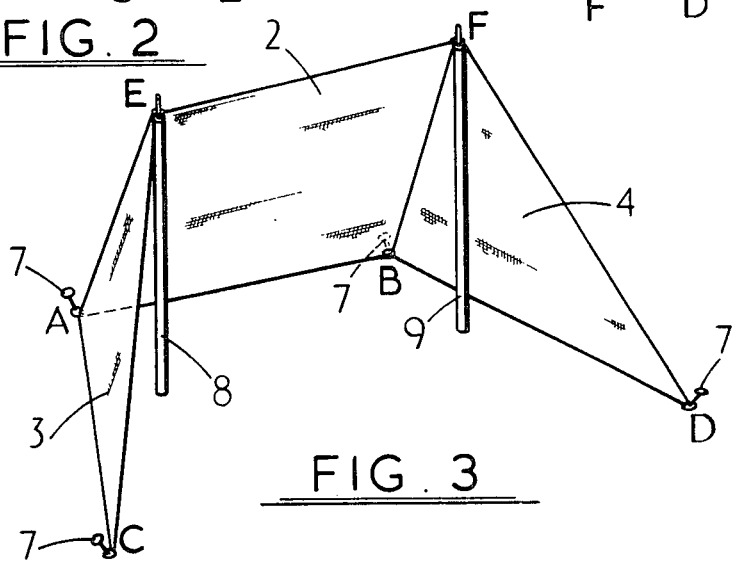

A practical embodiment of the invention is illustrated in the accompanying drawings in which FIG. 1 illustrates a flexible sheet laid out on the ground ready for erection, FIG. 1 shows an intermediate step in the process of erection and FIG. 3 shows the device erected.

In the drawings 1 denotes a sheet of flexible material having a quadrilateral centre portion 2 and two triangular wing portions 3 and 4 so orientated that they have bases 5 and 6 respectively common with respective opposite parallel sides of the quadrilateral centre portion 2. The sheet has six corners at A, B, C, D, E and F. A ring is located at each of the corners A to F, cords AE and BF, which are shown in double lines in FIG. 1 for illustrative purposes join the rings at the ends of the bases 5 and 6 of the wing portions 3 and 4 and cords AB, BD, DF, FE, EC and CA also shown in double lines in FIG. 1, join the adjacent pairs of rings at the corners around the periphery of the sheet. 7 denotes pegs serving to anchor the sheet and 8 and 9 denote poles holding the sheet in the erected position.

Figure 2:
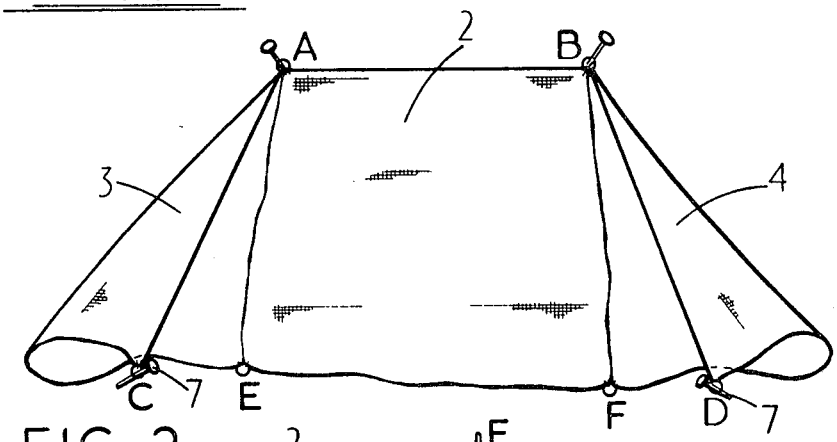

In practice, a net is erected by laying the sheet 1 out flat on the ground, pegs 7 such as tent pegs are inserted through the rings at the corners A and B and into the ground whereby to hold the edge AB to the ground. The apex C of the wind portion 3 is now lifted and swung backwardly towards the centre portion 2 keeping the edge CA taut until said apex C is part of the way towards the centre portion, i.e. in the position illustrated in FIG. 2. A peg 7 is then inserted through the ring at the apex C holding the apex to the ground to one side of the portion 2 of the sheet 1. The apex D of the other wing portion 4 is then treated similarly i.e. it is swung towards the centre portion 2 keeping the edge DB taut and when the apex D is part of the way towards the centre portion 2 in the position illustrated in FIG. 2 it also is pegged to the ground to the same side of the portion 2 of the sheet 1 as the apex D. A pole 8 preferably pointed at one end is then applied to the sheet so that the pointed end engages the unpegged ring E at a corner of the centre portion 2 and the pole is then brought to an erected position with the other end of the pole pressed against the ground. The edge of the net to which it is attached is thus raised above the ground. A second pole 9 is engaged with the other remaining unpegged ring F of the centre portion 2 and the second pole 9 is also brought to an erect position with the end not connected to the ring engaged with the ground. The edge EF of the centre portion is thus raised and held above and parallel to the ground supported by the erect poles 8 and 9. The action of raising the edge EF causes the attached wing portions 3, 4 to be erected at the same time. As the edges AC and BD of these wing portions 3 and 4 are, when the sheet 1 is flat, at an oblique angle to the edge AB, the centre portion 2 is caused to lean forwardly when the edges AC and BD are brought into contact with the ground by the act of pegging the apices C and D to the ground. The wing portions 3 and 4 are also caused to lean inwardly towards one another. This provides a recessed structure offering a high degree of protection and stability even in strong winds.

Erection is easy even in strong winds because the flexible sheet is first laid out flat on the ground where wind has little or no effect on it and then the actual erection is performed by merely raising two rigid poles without the use of any ropes.

What is claimed is:

1. A games practice net and protective screen incorporating a sheet of flexible material capable of being laid flat, the shape of the sheet when laid flat being that of a hexagon comprising a quadrilateral center portion and two triangular wing portions, all of the angles of said triangular wing portions being acute angles and said triangular wing portions being so orientated that the bases of the triangular wing portions are common with respective opposite parallel sides of the quadrilateral center portion so that the sheet has six sides and six salient corners, a ring located at each of the six corners, and a pair of cords connected to and linking the rings which are located at the corners defined by the ends of the bases of the triangular wing portions.

2. A games practice net as claimed in claim 1 further comprising a pair of support poles which, in use, extend through the rings located in the upper corners of the quadrilateral portion so as to support said sheet.

3. A games practice net and protective screen as claimed in claim 7 in which further cords are connected to and link all adjacent pairs of rings around the periphery of the sheet.

4. A games practice net and protective screen as claimed in claim 7 in which the rings are formed by loops of cord.

* * * * *